US007283616B2

(12) United States Patent
Freund et al.

(10) Patent No.: US 7,283,616 B2
(45) Date of Patent: Oct. 16, 2007

(54) COLLIMATOR, IN PARTICULAR FOR A COMPUTED TOMOGRAPH, AND METHOD FOR PRODUCING IT

(75) Inventors: Andreas Freund, Heroldsbach (DE); Juergen Leppert, Forchheim (DE); Michael Miess, Baiersdorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/238,058

(22) Filed: Sep. 29, 2005

(65) Prior Publication Data

US 2006/0067479 A1 Mar. 30, 2006

(30) Foreign Application Priority Data

Sep. 30, 2004 (DE) ..... 10 2004 047 616

(51) Int. Cl.
*G21K 1/02* (2006.01)

(52) U.S. Cl. ..... 378/147; 378/149

(58) Field of Classification Search ..... 378/147, 378/149; 250/505.1
See application file for complete search history.

(56) References Cited

U.S. PATENT DOCUMENTS 5,991,357 A * 11/1999 Marcovici et al. ..... 378/19
6,188,748 B1 * 2/2001 Pastyr et al. ..... 378/151
2005/0135562 A1 * 6/2005 Freund et al. ..... 378/147

FOREIGN PATENT DOCUMENTS

DE 100 11 877 9/2001

* cited by examiner

*Primary Examiner*—Courtney Thomas
(74) *Attorney, Agent, or Firm*—Harness, Dickey & Pierce

(57) ABSTRACT

A collimator is disclosed. The ends of collimator plates are potted with the aid of a top plate and a bottom plate with the formation of interspaces, defined by spacings, between the collimator plates. When producing such a collimator, the top and bottom plates are produced using a casting method, and the collimator plates are simultaneously cast in, in order to fix them in the bottom and top plates. For this production method, a reusable holding apparatus that holds the collimator plates, and a casting mold are provided for aligning and positioning purposes.

20 Claims, 5 Drawing Sheets

COLLIMATOR, IN PARTICULAR FOR A COMPUTED TOMOGRAPH, AND METHOD FOR PRODUCING IT

The present application hereby claims priority under 35 U.S.C. § 119 on German patent application number DE 10 2004 047 616.0 filed Sep. 30, 2004, the entire contents of which is hereby incorporated herein by reference.

FIELD

The invention generally relates to a collimator, and/or to a method for producing it.

BACKGROUND

A collimator is known from DE 100 11 877 C2.

The basis for calculating a computed, tomography tomogram is the attenuation, measured with the aid of detectors, of the X radiation passing through the patient, scattered radiation leading to falsification of these measured values and thus to unsharpnesses in the calculated image. Consequently, in computed tomographs collimators are fitted in front of the detectors in order to suppress scattered radiation and thus to ensure the measurement of X radiation passing through the patient predominantly in a straight line. These collimators generally include thin plates that are fabricated from material adsorbing X-rays and that have to be aligned in the shape of a fan with the X-ray source of the computed tomograph.

In the case of the collimator known from DE 100 11 877 C2, two side parts with side slots are provided for accommodating collimator plates. These side parts are designed as components of a lower and an upper half shell that can be joined and latched in an accurately fitting fashion and have a base plate and a cover plate with slots for plugging in the collimator plates.

The lower and the upper half shells are to be produced from injection-molded plastic in two separate production processes in one piece together with the base and the cover plates, in each case. In order to mount the collimator, it is provided firstly to fix the lower half shell with the collimator plates by plugging these plates into the side slots of the lower half shell and into the slots of the base plate, subsequently to join and latch the upper half shell by threading the collimator plates prepositioned in the lower half shell into the side slot of the upper half shell and plugging the plates into the slots of the cover plate, and finally fixing the collimator plates in the two half shells with the aid of adhesive.

SUMMARY

An object of at least one embodiment of the present invention to specify a collimator that ensures an exact positioning and fixing of the collimator plates in accommodating carrier parts despite a simplified producibility.

In the case of the inventive collimator according to at least one embodiment, and of the production method for a collimator according to at least one embodiment, it is possible to pot the bottom plate and the top plate by simultaneously casting in the lower and upper ends of the collimator plates in order to form a retaining receptacle such that it is possible to dispense with a separate production of the two half shells that are to be fabricated in an accurately fitting fashion to one another, and to dispense with the additional handling operation of a final fixing, for example bonding, of the collimator plates with the two half shells.

In the case of the production method in accordance with at least one embodiment, moreover, there is no need during mounting for side parts that are constructed with the collimator and in which there are present side slots for prepositioning the collimator plates, since provision is made of a reusable holding apparatus with slots for accommodating the collimator plates and which align the collimator plates in their orientation with the X-ray source, and simultaneously prepositions the collimator plates.

In a particularly advantageous way, there is provided for carrying out the production method a casting mold that, when the holding apparatus with the collimator plates prepositioned therein is enclosed in accordance with at least one embodiment of the invention, can be placed against said collimator plates such that the latter can be finely positioned by being displaced in their slots. Webs corresponding to the casting mold are provided in a structurally simple way in the region bearing against the collimator plates.

BRIEF DESCRIPTION OF THE DRAWINGS

The invention and further advantageous refinements of the invention are explained in more detail below in the drawing with the aid of schematic example embodiments, without thereby limiting the invention to these example embodiments; in the drawings.

DETAILED DESCRIPTION OF THE EXAMPLE EMBODIMENTS

Figure 1:
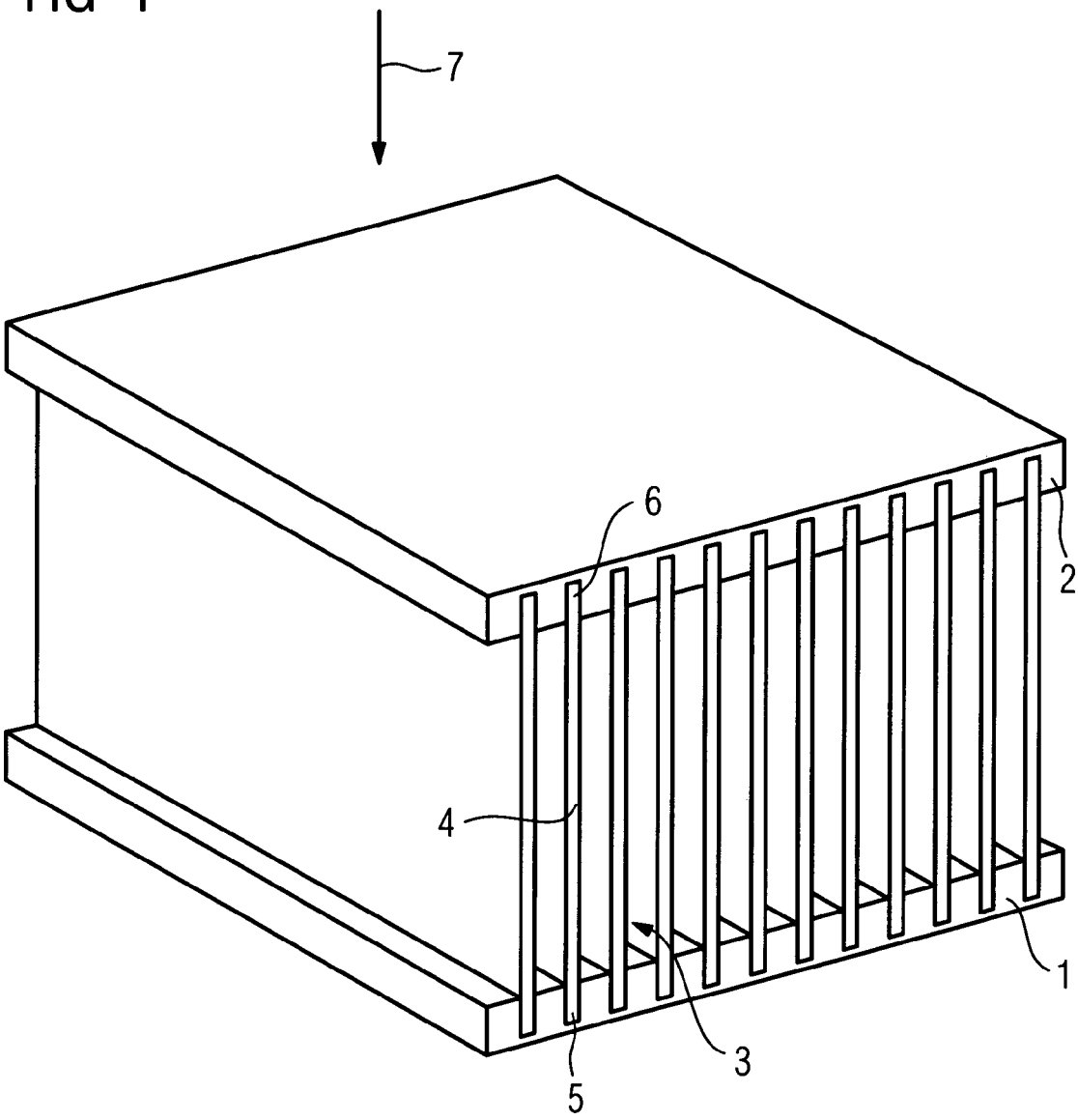
FIG. 1 shows a perspective illustration of a collimator with collimator plates potted at the ends in a bottom plate and in a top plate.

FIG. 1 shows a perspective illustration of a collimator with a bottom plate 1 produced as a casting, and with a top plate 2, likewise produced as a casting, into which collimator plates 4 are cast with their lower ends 5 and their upper ends 6 and are thereby fixed and held, interspaces 3 defined by spacings being formed in the process.

According to an advantageous refinement of at least one embodiment of the collimator, the bottom plate 1 and the top plate 2 are arranged substantially transverse to the collimator plates 4 aligned with the X-ray source, and consequently the two plates 1, 2 are arranged substantially transverse to the propagation direction 7 of the X radiation emanating from the X-ray source in the case when the collimator is fitted operationally in a computed tomograph; the bottom plate 1 and the top plate 2 are advantageously produced from a material such as plastic or aluminum, for example, that is largely transparent to X-rays.

Figure 2:
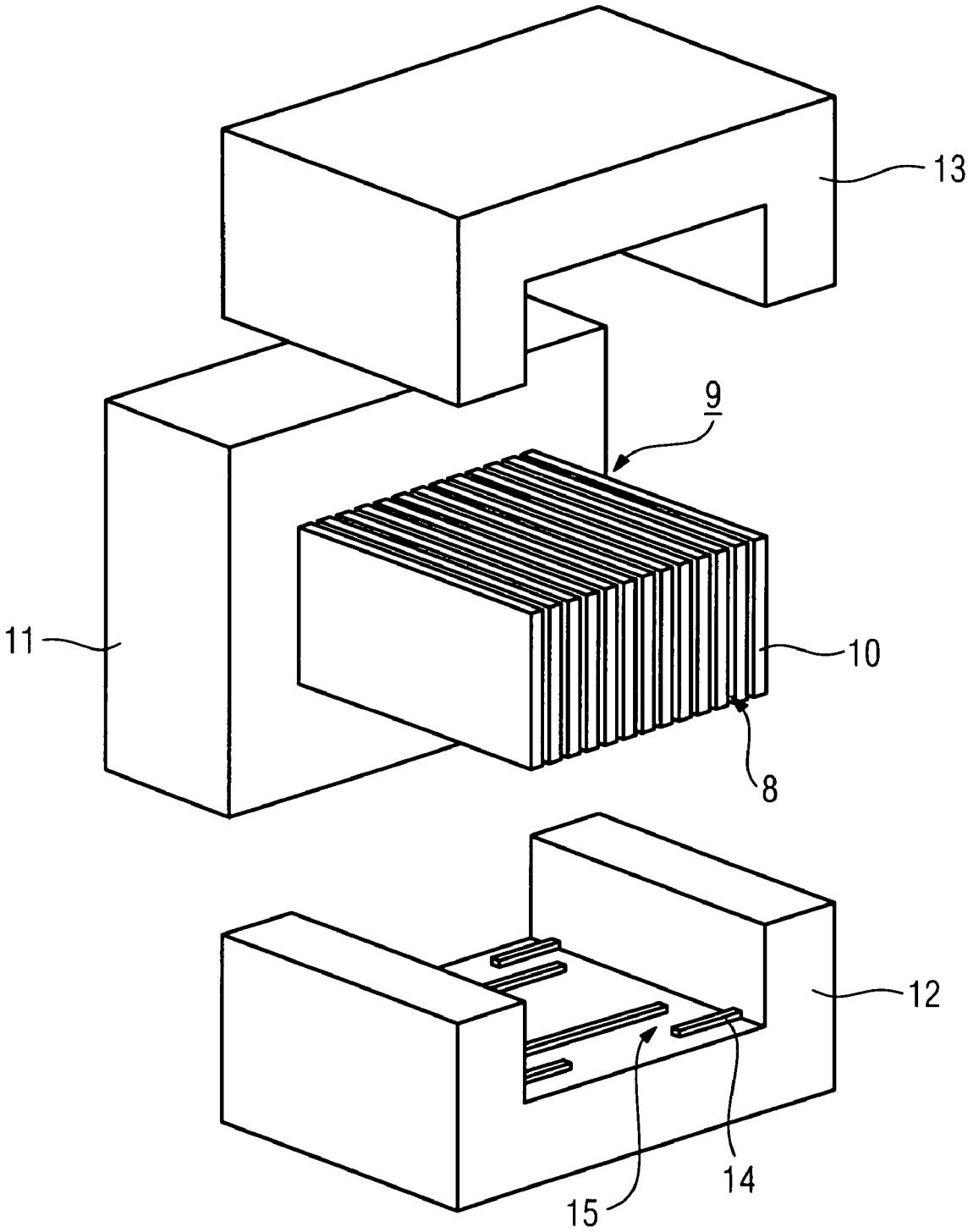
FIG. 2 shows a perspective illustration of an opened casting mold for producing the collimator and including a lower mold cavity and an upper mold cavity as well as a holding apparatus arranged in the casting mold.

FIG. 2 shows a perspective illustration of an opened casting mold 11, 12, 13, provided for producing a collimator, together with the holding apparatus 9 arranged therein. The holding apparatus 9 is advantageously designed like a comb with protruding teeth 10. These teeth 10 on the one hand establish the interspaces, defined by spaces, for the collimator plates, and on the other hand they delimit slots 8 for accommodating the collimator plates.

According to a structurally simple refinement, the teeth 10 are connected at their side averted from the free ends by a holding plate 11 with which they form, in particular, a one-piece structural unit. This holding plate 11 is simultaneously also used with particular simplicity as rear wall part on the casting mold.

In addition to the rear wall part mentioned, the casting mold includes a bottom casting mold part in the form of a lower mold cavity 12, and a top casting mold part in the form of an upper mold cavity 13. Provided on the lower mold cavity are webs 14 with passage openings 15 for casting material that are determined together with the corresponding webs, not visible in FIG. 2 because of the perspective line of sight, on the upper mold cavity for accommodating collimator plates at defined spacings.

Figure 3:
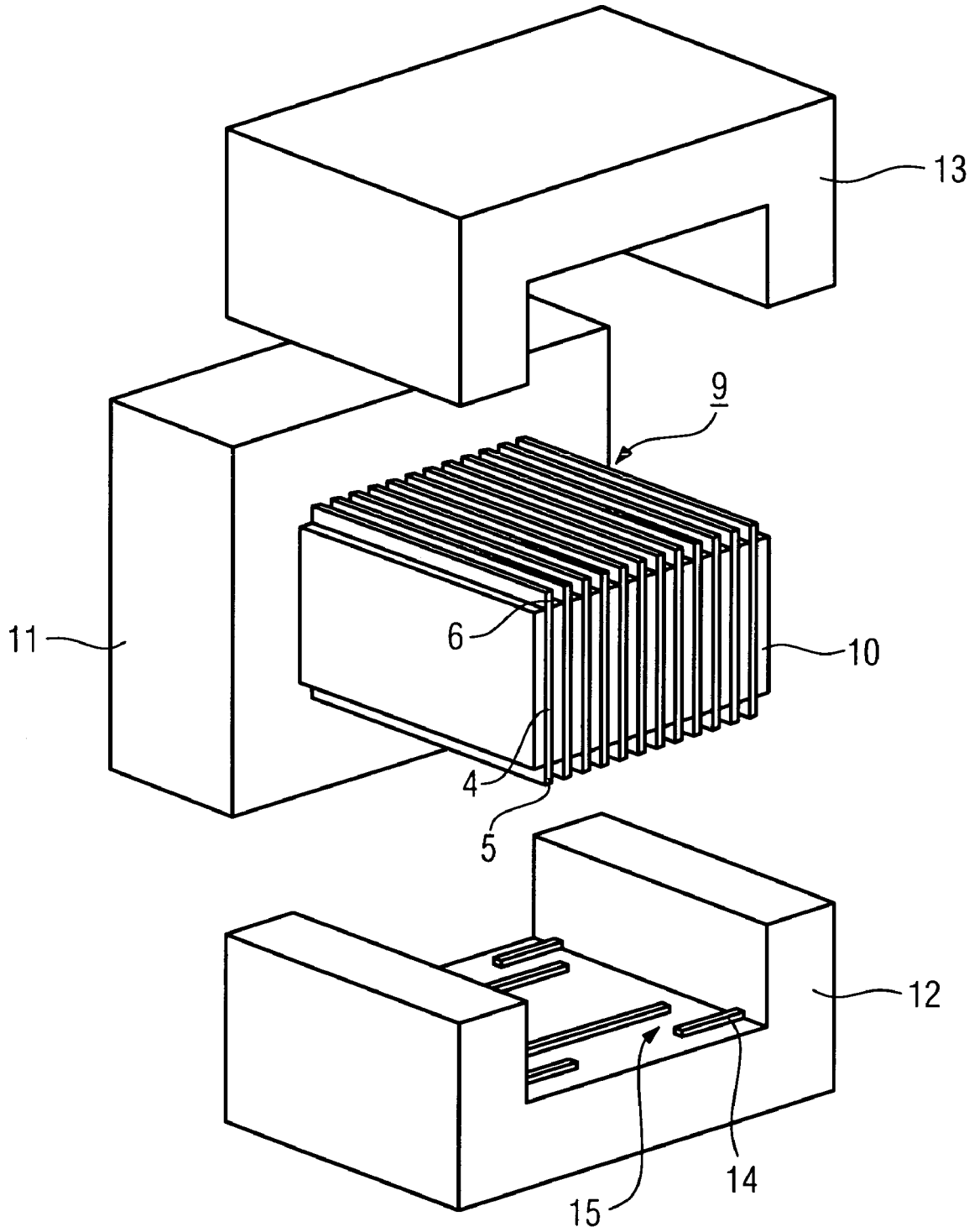
FIG. 3 shows a perspective illustration of the arrangement from FIG. 2 with collimator plates accommodated by the holding apparatus.
Figure 4:
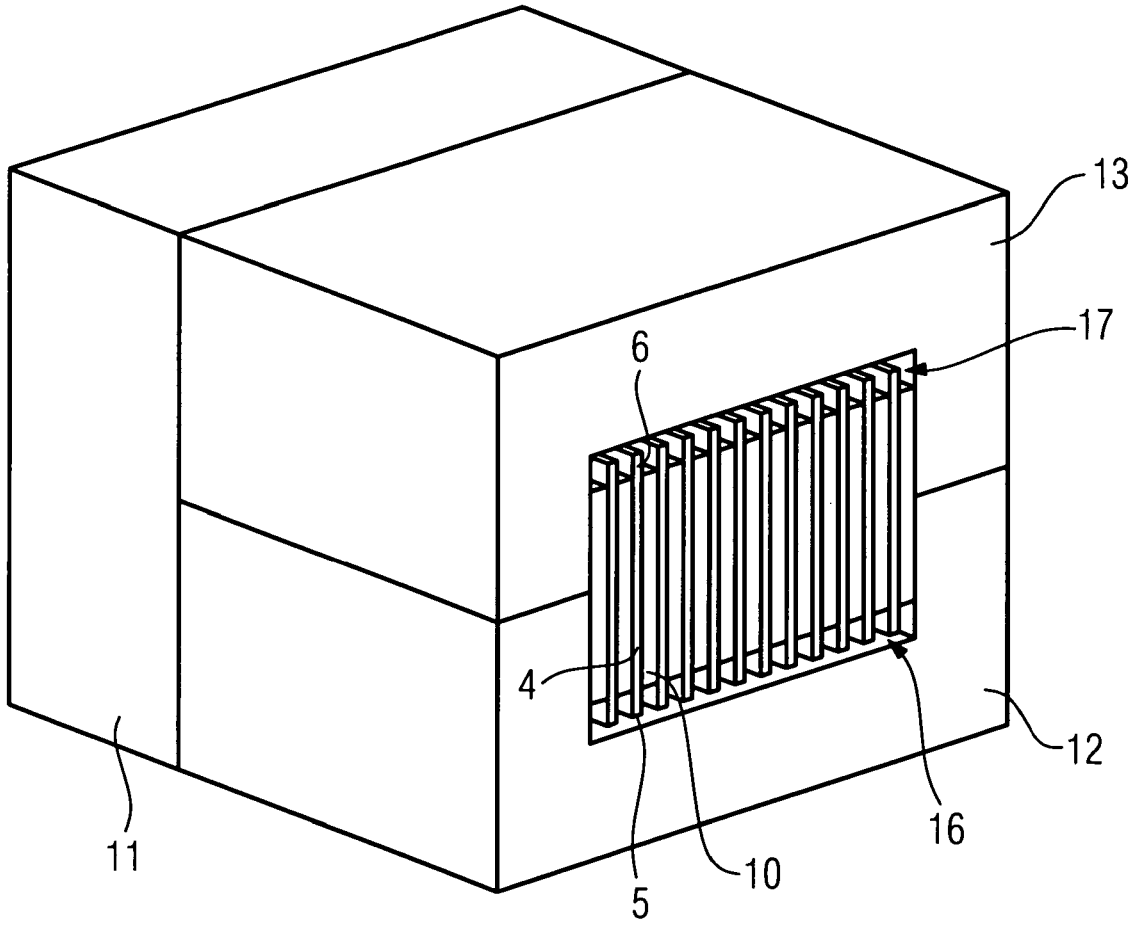
FIG. 4 shows a perspective illustration of the arrangement from FIG. 3 with a closed casting mold that is therefore placed against the collimator plates.
Figure 5:
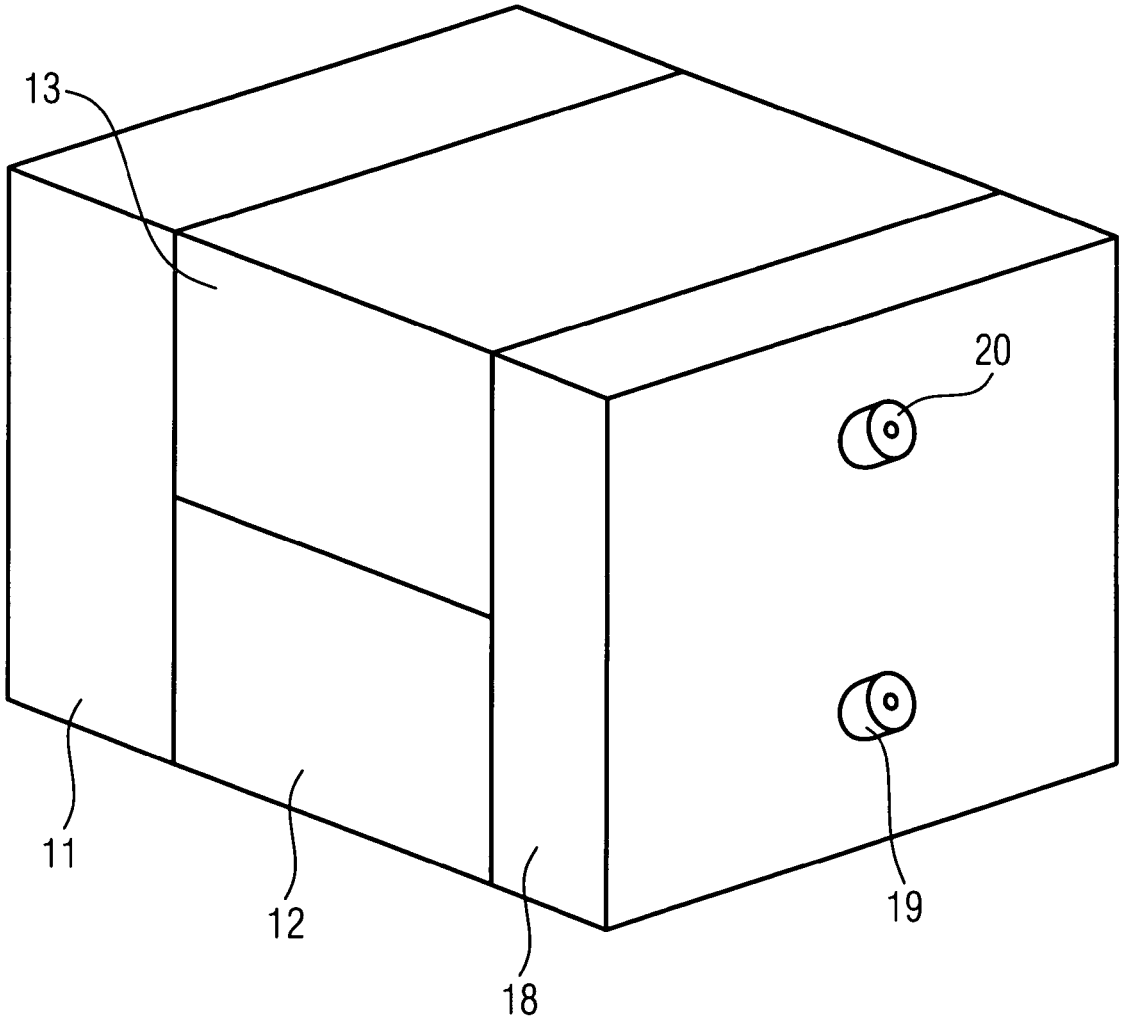
FIG. 5 shows a perspective illustration of the arrangement from FIG. 4 with an additional front wall part.

FIGS. 3-5 illustrate individual steps in a method for producing a collimator.

FIG. 3 shows the casting mold 11, 12, 13 and the holding apparatus 9 from FIG. 2, collimator plates 4 now being inserted into the slots of the holding apparatus. The collimator plates 4 can be aligned via the slots in such a way that they are oriented in the direction of the X-ray source when the collimator is operationally fitted in the computed tomograph. The collimator plates 4 are already prepositioned by bearing against the rear wall part 11 and owing to the rough vertical positioning through being held in the slots of the holding apparatus 9. The teeth 10 of the holding apparatus 9 fill up the interspaces between the collimator plates 4, but do not enclose the ends 5, 6 of the collimator plates 4.

FIG. 4 shows the arrangement from FIG. 3, the lower mold cavity 12 and the upper mold cavity 13 enclosing, in accordance with a further method step, the holding apparatus with the collimator plates 4 held therein. The already prepositioned collimator plates 4 can be finely positioned to adopt defined spacings by displacement in the slots of the holding apparatus by placement of the webs of the two mold cavities 12, 13. Present in the region of the lower ends 5 and the upper ends 6 of the collimator plates 4 are unpotted spaces 16, 17 according to at least one embodiment of the invention that are provided in a later method step for filling with casting material, and in the process form the lower plate 12 and the upper plate 13, respectively, of the collimator.

FIG. 5 shows the arrangement for FIG. 4 terminated by a front wall part 18; the casting has filling openings 19, 20 for filling in casting material and for filling up the unpotted spaces. In a particularly uncomplicated way, the casting mold consists only of the lower mold cavity 12, the upper mold cavity 13, the rear casting mold wall part 11 in the form of the holding plate of the holding apparatus, and the front wall part 18.

The bottom plate and the top plate of the collimator are produced by filling the casting mold, the ends of the collimator plates being potted with these plates and thereby fixed. Subsequently, the casting mold is opened and the finished collimator, similar to that shown in FIG. 1, is separated from the reusable holding apparatus by withdrawing the teeth connected by the holding plate.

At least one embodiment of the invention can be summarized in principle as follows: in the case of the collimator, in particular for a computed tomograph, the ends (5, 6) of collimator plates (4) are potted, with the formation of interspaces (3) defined by spacings, between the collimator plates with a top plate (2) and a bottom plate (1). When producing such a collimator, the top and bottom plates (1, 2) are produced using a casting method, and the collimator plates (4) are simultaneously cast in, in order to fix them in the bottom and top plates (1, 2). For this production method, a reusable holding apparatus (9) that holds the collimator plates (4), and a casting mold (11-13) are provided for aligning and positioning purposes.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A collimator; comprising:

collimator plates, aligned with an X-ray source located outside the collimator and fixed to a bottom plate and a top plate with a formation of interspaces defined by spacings, the bottom plate and the top plate being cast potted with at least one of lower ends and upper ends of the collimator plates to form a retaining receptacle.

2. The collimator as claimed in claim 1, wherein the bottom plate and the top plate are substantially arranged transverse to the aligned collimator plates.

3. The collimator as claimed in claim 1, wherein at least one of the bottom plate and the top plate include a material largely transparent to X-rays.

4. The collimator as claimed in claim 1, wherein at least one of the bottom plate and the top plate include plastic.

5. The collimator as claimed in claim 1, wherein at least one of the bottom plate and the top plate include aluminum.

6. The collimator of claim 1, formed by a method comprising:

inserting the collimator plates into corresponding slots of a prepositioning holding apparatus that aligns the collimator plates relative to the X-ray source, unpotted spaces being provided that remain in a region of the lower and upper ends of the collimator plates and correspond to the bottom and top plates respectively, the interspaces defined by spacings otherwise being filled up by the holding apparatus;

using a casting mold to accommodate and enclose the holding apparatus with the collimator plates held therein;

filling the enclosing casting mold; and opening the casting mold and separating the collimator from the holding apparatus.

7. A collimator as claimed in claim 1, wherein the collimator is for a computed tomograph.

8. A computed tomograph including the collimator of claim 1.

9. The collimator as claimed in claim 2, wherein at least one of the bottom plate and the top plate include a material largely transparent to X-rays.

10. The collimator as claimed in claim 2, wherein at least one of the bottom plate and the top plate include plastic.

11. The collimator as claimed in claim 2, wherein at least one of the bottom plate and the top plate include aluminum.

12. The collimator of claim 2, formed by a method comprising:

inserting the collimator plates into corresponding slots of a prepositioning holding apparatus that aligns the collimator plates relative to the X-ray source, unpotted spaces being provided that remain in the region of the lower and upper ends of the collimator plates and correspond to the bottom and top plates respectively, the interspaces defined by spacings otherwise being filled up by the holding apparatus;

using a casting mold to accommodate and enclose the holding apparatus with the collimator plates held therein;

filling the enclosing casting mold; and opening the casting mold and separating the collimator from the holding apparatus.

13. A method for producing a collimator, comprising:

inserting collimator plates into corresponding slots of a prepositioning holding apparatus that aligns the collimator plates in their orientation with an X-ray source, unpotted spaces being provided that remain in the region of lower and upper ends of the collimator plates and correspond to bottom and top plates respectively, the interspaces defined by spacings otherwise being filled up by the holding apparatus;

using a casting mold to accommodate and enclose the holding apparatus with the collimator plates held therein;

filling the enclosing casting mold; and opening the casting mold and separating the collimator from the holding apparatus.

14. The method of claim 13, wherein the holding apparatus has a comb-like design with protruding teeth that establish the interspaces, defined by the spacings and delimit the slots.

15. A holding apparatus for forming a collimator, comprising:

a comb-like design with protruding teeth that establish interspaces, defined by spacings, for collimator plates of the collimator, and delimit slots configured to receive the collimator plates, wherein the holding apparatus holds the collimator plates, which are cast potted to at least one of a bottom plate and a top plate of the collimator.

16. The holding apparatus as claimed in claim 15, wherein the teeth of the holding apparatus are connected on one side by a holding plate.

17. The holding apparatus as claimed in claim 16, wherein the holding plate is a rear wall part of a casting mold.

18. A casting mold for forming a collimator, comprising:

a rear casting mold wall part configured to support a holding apparatus, which delimits slots configured to receive collimator plates of the collimator;

a bottom casting mold part configured to enclose lower ends of the collimator plates; and a top casting mold part configured to enclose upper ends of the collimator plates, wherein the collimator plates are finely positionable in the slots and unpotted spaces remain in regions of the lower ends and upper ends of the collimator plates when the bottom casting mold part and the top casting mold part enclose the collimator plates.

19. The casting mold as claimed in claim 18, wherein, each of the bottom casting mold part and the top casting mold part include accommodating the collimator plates and creating passage openings for casting material.

20. The casting mold as claimed in claim 18, further comprising:

a front wall part having at least one filling opening.

* * * * *